US006164207A

United States Patent [19]

Junghans

[11] Patent Number: 6,164,207

[45] Date of Patent: Dec. 26, 2000

[54] METHOD AND DEVICE FOR CONTROLLING THE TEMPERATURE OF AN INK DUCT ROLLER IN AN INKING UNIT OF A ROTARY PRINTING PRESS

[75] Inventor: Rudi Junghans, Wilhelmsfeld, Germany

[73] Assignee: Heidelberger Druckmaschinen Aktiengesellschaft, Heidelberg, Germany

[21] Appl. No.: 09/169,775

[22] Filed: Oct. 9, 1998

[30] Foreign Application Priority Data

Oct. 9, 1997 [DE] Germany ..... 197 44 491

[51] Int. Cl.[7] ..... B41F 23/04

[52] U.S. Cl. ..... 101/487; 101/216

[58] Field of Search ..... 101/487, 488, 101/142, 216, 217, 212, 219

[56] References Cited

U.S. PATENT DOCUMENTS

| | | | |
|---|---|---|---|
| 2,972,460 | 2/1961 | Shindle | 101/416 |
| 3,704,669 | 12/1972 | Christoff . | |
| 4,481,790 | 11/1984 | Mattes . | |
| 5,293,819 | 3/1994 | Fukuda | 101/350 |
| 5,720,221 | 2/1998 | Harig et al. | 101/148 |
| 5,749,295 | 5/1998 | Kurz | 101/350 |

FOREIGN PATENT DOCUMENTS

| | | |
|---|---|---|
| 32 28 124 A1 | 11/1983 | Germany . |
| 195 02 475 A1 | 8/1996 | Germany . |
| 2 297 292 | 7/1996 | United Kingdom . |

*Primary Examiner*—John S. Hilten
*Assistant Examiner*—Darius N. Cone
*Attorney, Agent, or Firm*—Herbert L. Lerner; Laurence A. Greenberg; Werner H. Stemer

[57] ABSTRACT

A method and device for controlling the temperature of an ink duct roller in an inking unit of a rotary printing press, wherein machine oil is supplied to the interior of the ink duct roller as a temperature control medium, and a line system for the machine oil is connected to an oil circuit and an oil reservoir of the printing press, includes temperature controlling and cooling, in a separate system, the machine oil supplied to the ink duct roller from an oil circuit of the printing press.

4 Claims, 1 Drawing Sheet

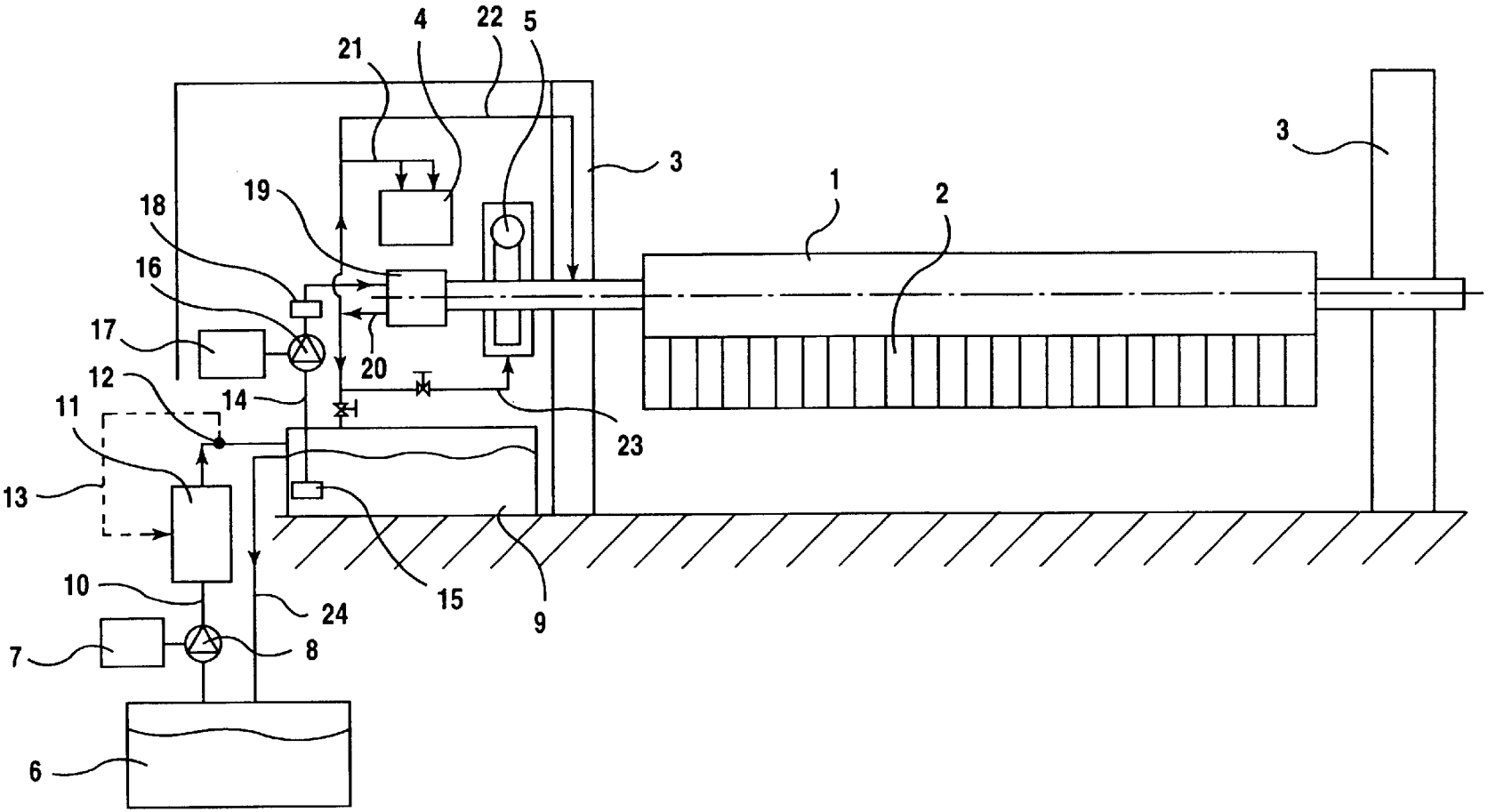
3
2
1
3
23
5
22
4
21
20
19
18
16
17
14
12
11
13
15
9
24
8
10
7
6

METHOD AND DEVICE FOR CONTROLLING THE TEMPERATURE OF AN INK DUCT ROLLER IN AN INKING UNIT OF A ROTARY PRINTING PRESS

BACKGROUND OF THE INVENTION

Field of the Invention

The invention relates to a method and device for controlling the temperature of an ink duct roller in an inking unit of a rotary printing press, wherein machine oil is supplied to the interior of the ink duct roller as a temperature control medium, and a line system for the machine oil is connected to an oil circuit and an oil reservoir of the printing press.

In a conventional construction of this general type described in the published German Patent Document DE 19 502 475 A1, there is illustrated an embodiment of an ink duct roller to which machine oil is supplied for temperature control, so that the temperature of the ink duct roller can be maintained at a constant value that is not disturbed by any possible interruption in pressure. The viscosity of the ink can thereby be kept constant, so that a uniform supply of ink to the inking unit and, therefore, to a printing plate is ensured. It has been shown, however, that the machine oil is also subject to temperature fluctuations, which may have an adverse effect upon the temperature control of the ink duct roller.

SUMMARY OF THE INVENTION

Proceeding from this state of the prior art, it is accordingly an object of the invention of the instant application, when there is a constant supply of lubricating oil, to avoid adverse influences due to fluctuations in the temperature of the latter.

With the foregoing and other objects in view, there is provided, in accordance with one aspect of the invention, a method for controlling the temperature of an ink duct roller in an inking unit of a rotary printing press, wherein machine oil is supplied to the interior of the ink duct roller as a temperature control medium, and a line system for the machine oil is connected to an oil circuit and an oil reservoir of the printing press, which comprises temperature controlling and cooling, in a separate system, the machine oil supplied to the ink duct roller from the oil circuit of the printing press.

In accordance with another aspect of the invention, there is provided a device for controlling the temperature of an ink duct roller in an inking unit of a rotary printing press, wherein machine oil is supplied to the interior of the ink duct roller as a temperature control medium, and a line system for the machine oil is connected to an oil circuit and an oil reservoir of the printing press, comprising a cooling assembly for the machine oil connected upline to the oil reservoir of the printing press, and lines for supplying the cooled machine oil to a mixing tank and from the mixing tank to the ink duct roller and to lubricating locations of a bearing and a drive for the ink duct roller.

In accordance with another feature of the invention, an oil pump and a temperature regulator are assigned to the cooling assembly.

In accordance with a further feature of the invention, an oil pump for supplying the ink duct roller and the lubricating locations is assigned to the mixing tank.

In accordance with a concomitant feature of the invention, the device includes a connection between the ink duct roller and the mixing tank for supplying machine oil flowing back from the ink duct roller to the mixing tank.

Thus, the machine oil supplied to the ink duct roller from the oil circuit of the printing press is temperature-controlled/cooled in a separate system. This provision makes it possible to control the temperature of or cool the ink duct roller independently of the machine oil, so that constant inking of the plate cylinder over the entire operating period of the printing machine can be achieved.

Due to the additional possibility of cooling the machine oil, excessive temperatures of the ink duct roller can be avoided. With the mixing tank for the machine oil, it is possible that small oil quantities can be employed and that, as an essential further advantage, an oil supply will be present in the mixing tank if the main lubrication system of the printing press should fail, thereby ensuring that lubricating oil will be supplied to the bearing locations and to the drive of the ink duct roller, so that the printing press can continue to run for some time. For these purposes, the required machine oil is extracted from the mixing tank and returned to the aforementioned in a circuit.

The oil pump permits the lubricating oil to be extracted directly from the oil reservoir of the printing press and supplied to the cooling assembly. Furthermore, according to the invention, the mixing tank has an oil pump for supplying the ink duct roller and the lubricating locations assigned thereto, so that a separate supply from the mixing tank can be maintained via this additional oil pump.

The machine oil flowing back from the ink duct roller is supplied to the mixing tank, so that there is a constant oil supply in the latter. Only the freshly temperature-controlled machine oil supplied via the cooling assembly and entering the mixing tank is compensated, and the corresponding quantity is supplied to the oil reservoir of the printing press again via an overflow line.

Other features which are considered as characteristic for the invention are set forth in the appended claims.

Although the invention is illustrated and described herein as a method and device for controlling the temperature of an ink duct roller in an inking unit of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

BRIEF DESCRIPTION OF THE DRAWING

A single FIGURE of the drawing is a schematic and diagrammatic view of an exemplary device for controlling the temperature of an ink duct roller in an inking unit of a rotary printing press in accordance with the invention.

DESCRIPTION OF THE PREFERRED EMBODIMENTS

Referring now particularly to the single FIGURE of the drawing, there is shown therein an ink duct or fountain roller 1 and an ink duct or fountain 2 mounted in side frames 3 of a rotary printing press. The ink duct roller 1 is driven via a motor 4 and a gear transmission 5, and transfers an adjustable quantity of ink into an inking unit of the printing press.

An oil reservoir 6 of the printing press supplies machine oil to a mixing tank 9 via an oil pump 8 driven by a motor 7. A cooling assembly 11, which may be constructed, for example, as a heat exchanger, is provided downstream of the oil pump 8, as viewed in a travel direction of the machine oil in a supply line 10. Furthermore, a temperature sensor 12 is provided, which cooperates with a temperature regulating device 13, so that the temperature of the machine oil supplied to the mixing tank 9 can be regulated precisely in accordance with requirements.

A suction line 14 having a suction screen or box 15 terminates in the mixing tank 9, the suction line 14 being connected to a second oil pump 16 which can likewise be driven via a motor 17. The pump 16 conveys the machine oil out of the mixing tank 9, via a pressure filter 18 and a rotary leadthrough 19, into the interior of the ink duct roller 1. The machine oil flowing back via a line 20 is then supplied, for lubrication purposes, to the motor 4, the gear transmission 5 and a bearing for the ink duct roller 1 in the press side frame 3. In this regard, a line 21 feeds the lubricating motor oil to the motor 4, a line 22 to the bearing location, and a line 23 to the gear transmission 5. Excess oil flows back to the mixing tank 9. After temperature-controlled machine oil is present in the mixing tank 9, the pump 16 feeds cooled machine oil in a separate system to the ink duct roller 1 and the various lubricating locations. For compensating the supplied temperature-controlled machine oil via the supply line 10, an overflow line 24 is provided, which returns excess machine oil into the oil reservoir 6 of the printing press.

I claim:

1. A method for controlling the temperature of an ink duct roller in an inking unit of a rotary printing press, which comprises:

supplying machine oil from a mixing tank through the ink duct roller to a gear unit;

feeding back excess oil from the lubrication of the gear unit to said mixing tank; and supplying cooled machine oil to the mixing tank from an oil reservoir via a cooling assembly;

mixing cooled machine oil and heated machine oil in the mixing tank;

feeding back excess machine oil from the mixing tank to the oil reservoir.

2. A device for controlling the temperature of an ink duct roller in the inking unit of a rotary printing press, with a line system for supplying machine oil as a temperature medium to an interior of the ink fountain roller, comprising:

a line system consisting of a first oil circuit and a second oil circuit;

said first oil circuit consisting of an oil reservoir and a cooling assembly which follows the oil reservoir in the oil flow;

said second oil circuit consisting of an ink duct roller and a gear unit which follows the ink duct roller in the oil flow;

said first and second oil circuits being connected via a mixing tank wherein the cooled machine oil from the cooling assembly is mixed with the heated machine oil from the ink duct roller and the gear unit.

3. The device according to claim 2, wherein an oil pump and a temperature regulator are assigned to said cooling assembly.

4. The device according to claim 2, wherein an oil pump for supplying the ink duct roller and said lubricating locations is assigned to said mixing tank.

* * * * *